US006598936B1

(12) United States Patent
Klein

(10) Patent No.: US 6,598,936 B1
(45) Date of Patent: Jul. 29, 2003

(54) MULTI-TASK MID-PIVOT CHAIR CONTROL MECHANISM

(76) Inventor: Michael N. Klein, 412 S. Lincoln Dr., Howards Grove, WI (US) 53083

( * ) Notice: Subject to any disclaimer, the term of this patent is extended or adjusted under 35 U.S.C. 154(b) by 41 days.

(21) Appl. No.: 09/832,776

(22) Filed: Apr. 11, 2001

(51) Int. Cl.[7] ..... A47C 1/024

(52) U.S. Cl. ..... 297/301.2; 297/301.3; 297/301.5; 297/301.6; 297/300.4; 297/300.6

(58) Field of Search ..... 297/301.3, 301.5, 297/301.6, 309, 310, 337, 354.12, 300.6, 300.4

(56) References Cited

U.S. PATENT DOCUMENTS

| | | | | |
|---|---|---|---|---|
| 1,746,986 | A | | 2/1930 | Bell |
| 2,329,327 | A | | 9/1943 | Boerner |
| 2,771,124 | A | | 11/1956 | Borsani |
| 3,522,970 | A | | 8/1970 | Francis |
| 3,879,082 | A | | 4/1975 | Gwin |
| 4,065,176 | A | | 12/1977 | Fontana |
| 4,123,103 | A | | 10/1978 | Doerner |
| 4,183,581 | A | | 1/1980 | Karrip et al. |
| 4,248,479 | A | | 2/1981 | Toda |
| 4,364,602 | A | | 12/1982 | Rigazio |
| 4,494,795 | A | | 1/1985 | Roossien et al. |
| 4,555,085 | A | | 11/1985 | Bauer et al. |
| 4,629,249 | A | | 12/1986 | Yamaguchi |
| 4,636,003 | A | | 1/1987 | Siebler |
| 4,636,004 | A | | 1/1987 | Neumuller |
| 4,682,815 | A | | 7/1987 | Steifensand |
| 4,718,726 | A | | 1/1988 | Estkowski et al. |
| 4,720,142 | A | | 1/1988 | Holdredge et al. |
| 4,752,101 | A | | 6/1988 | Yurchenco et al. |
| 4,818,020 | A | | 4/1989 | Meiller et al. |
| 4,832,402 | A | | 5/1989 | Zund |
| 4,890,886 | A | | 1/1990 | Opsvik |
| 4,892,354 | A | | 1/1990 | Estkowski et al. |
| 4,943,115 | A | | 7/1990 | Stucki |
| 5,029,940 | A | | 7/1991 | Golynsky et al. |
| 5,046,780 | A | | 9/1991 | Decker et al. |
| 5,066,069 | A | * | 11/1991 | DeGelder |
| 5,080,318 | A | | 1/1992 | Takamatsu et al. |
| 5,280,998 | A | | 1/1994 | Miotto et al. |
| 5,328,242 | A | | 7/1994 | Steffens et al. |
| 5,340,194 | A | | 8/1994 | Neumuller |
| 5,348,371 | A | | 9/1994 | Miotto |
| 5,356,200 | A | | 10/1994 | Stumpf et al. |
| 5,385,388 | A | | 1/1995 | Faiks et al. |
| 5,499,861 | A | | 3/1996 | Locher |
| 5,658,045 | A | | 8/1997 | Van Koolwijk et al. |
| 5,662,381 | A | | 9/1997 | Roossien et al. |
| 5,664,834 | A | | 9/1997 | Hsu |
| 5,683,139 | A | | 11/1997 | Golynsky et al. |
| 5,685,609 | A | | 11/1997 | Miotto |
| 5,725,276 | A | | 3/1998 | Ginat |
| 5,755,490 | A | | 5/1998 | Lamart |
| 5,782,536 | A | | 7/1998 | Heidmann et al. |
| 5,810,439 | A | * | 9/1998 | Rosulnd, Jr. |
| 5,909,923 | A | | 6/1999 | DeKraker |
| 5,918,938 | A | | 7/1999 | Miotto |
| 6,027,169 | A | | 2/2000 | Roslund, Jr. |
| 6,039,397 | A | | 3/2000 | Ginat |
| 6,120,096 | A | | 9/2000 | Miotto |
| 6,213,552 | B1 | | 4/2001 | Miotto |
| 6,273,506 | B1 | * | 8/2001 | Neirgarth |
| 6,439,661 | B1 | * | 8/2002 | Brauning |

* cited by examiner

*Primary Examiner*—Laurie K. Cranmer
(74) *Attorney, Agent, or Firm*—Shook, Hardy & Bacon L.L.P.

(57) ABSTRACT

A chair control mechanism for positioning between the seat and seat support of a chair. The chair control mechanism includes a base section for mounting to a seat support such as an adjustable height cylinder, and a seat mounting section pivotably interconnected with the base section. A seat is mounted to the seat mounting section, and is pivotable about a seat pivot axis. An adjustable position back mounting arrangement is pivotably interconnected with the seat mounting section, and the chair back is engageable with the back mounting section. A variable stop arrangement is interposed between the base section and the seat mounting section, for varying the range of pivoting movement of the seat relative to the seat support. The back can be selectively locked in one of a number of predetermined positions relative to the seat by operation of a variable position back locking arrangement.

14 Claims, 4 Drawing Sheets

FIG. 3.
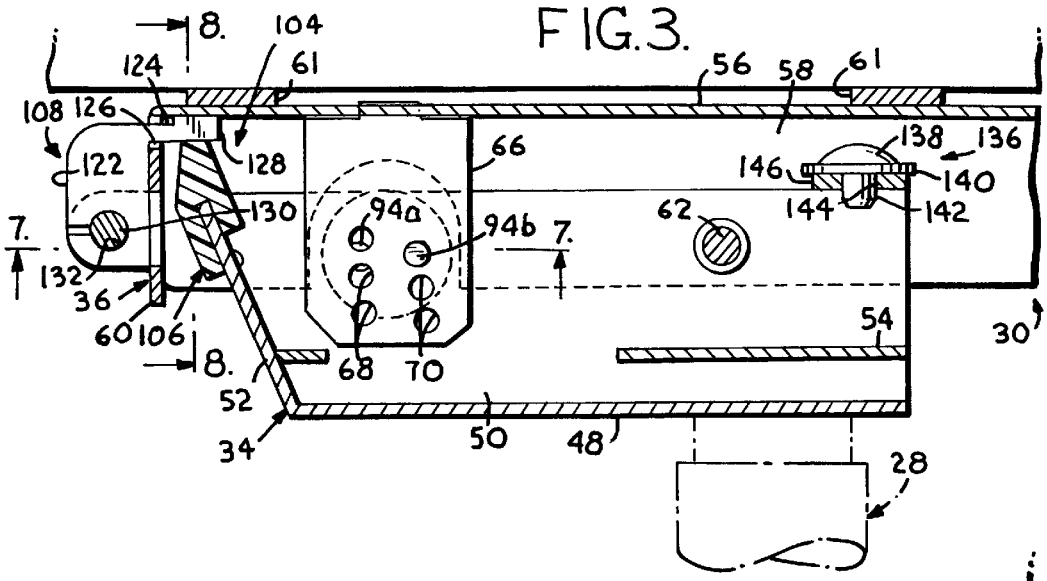
FIG. 4.
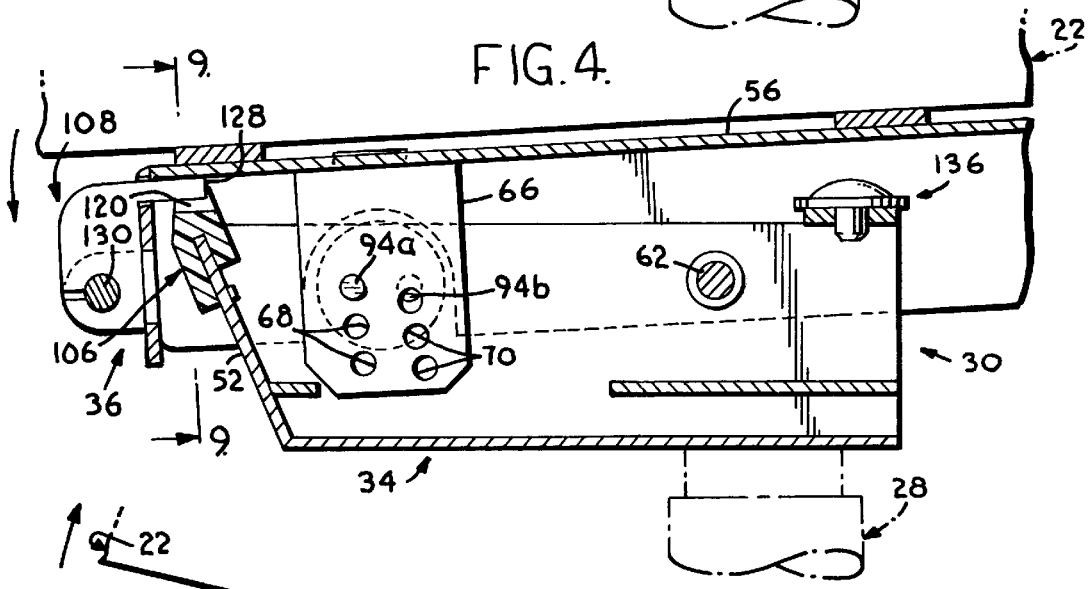
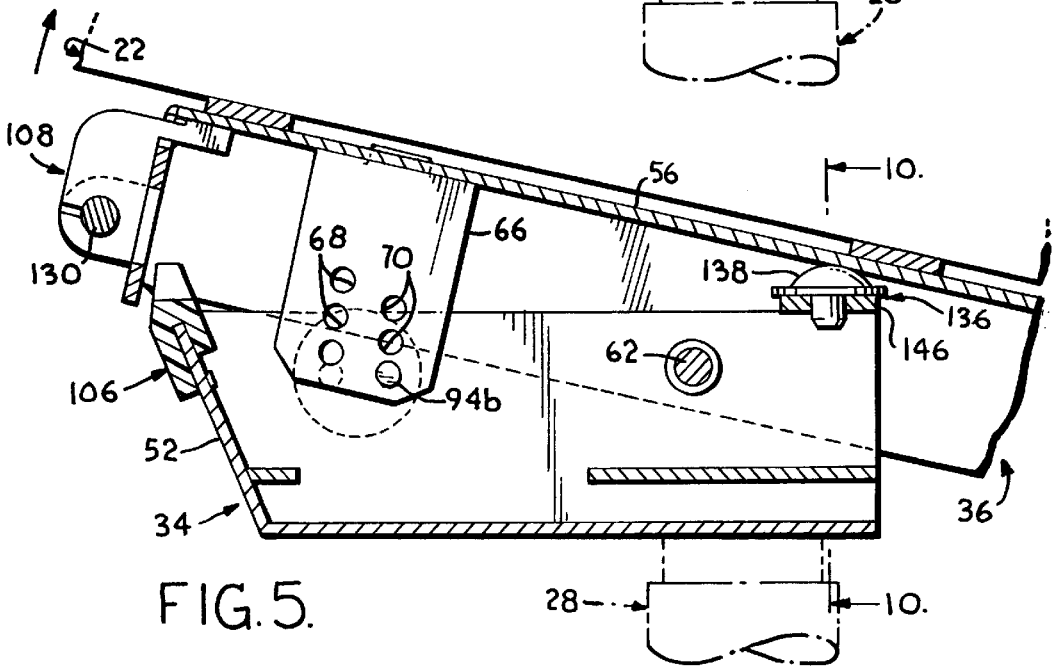
FIG. 5.

FIG. 7.
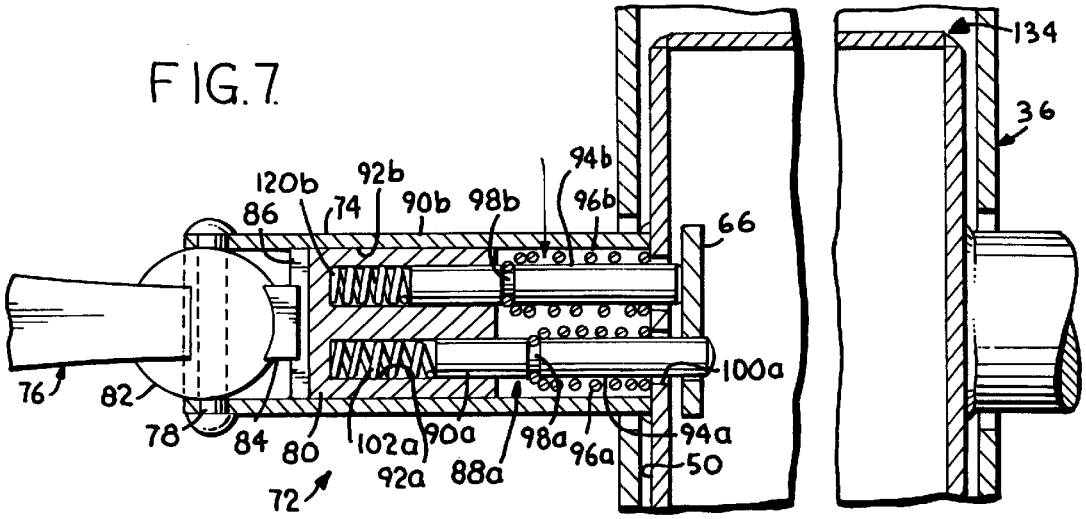
FIG. 8.
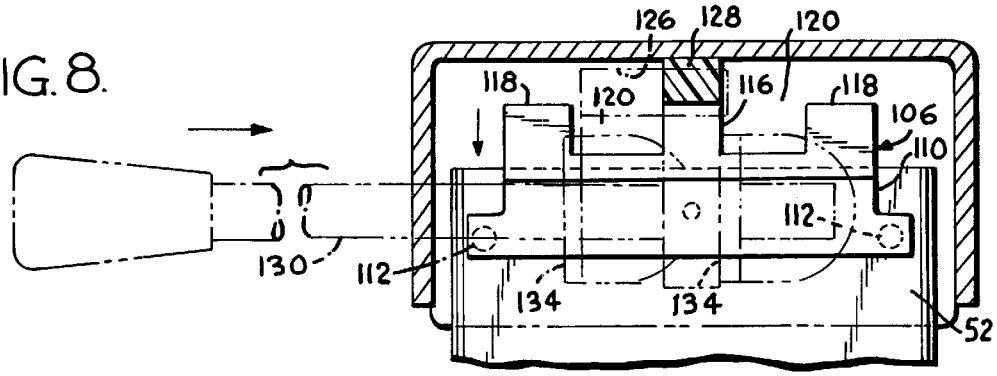
FIG. 9.
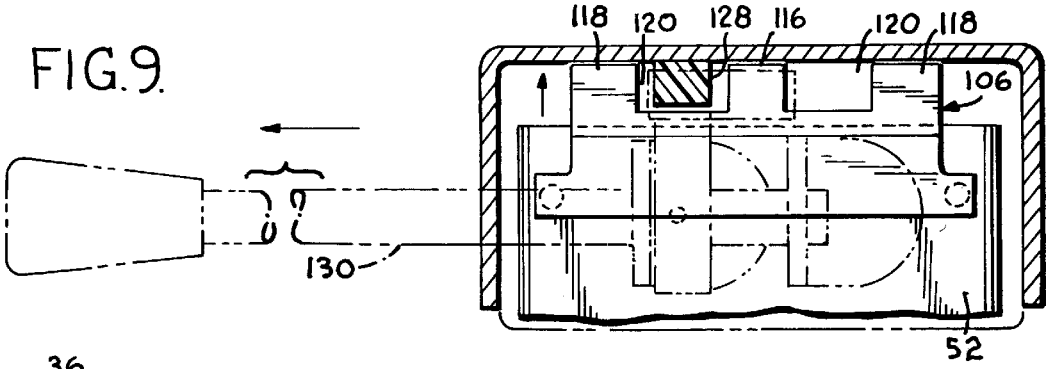
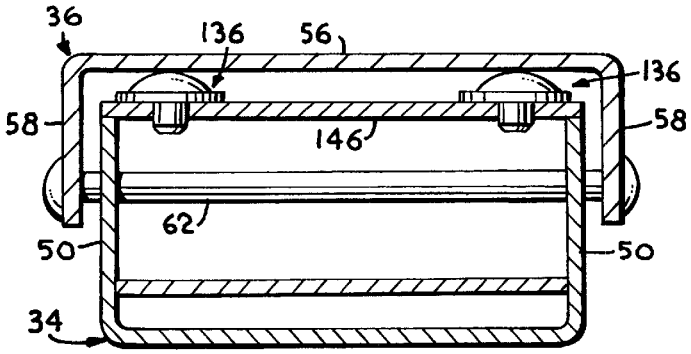
FIG. 10.

MULTI-TASK MID-PIVOT CHAIR CONTROL MECHANISM

BACKGROUND AND SUMMARY OF THE INVENTION

This invention relates to a chair control mechanism, and more particularly to various features enhancing the operation and flexibility of a chair control mechanism of the mid-pivot type.

Various chair control mechanisms are known, for controlling the position of a chair seat relative to a seat support, such as an upstanding chair support pedestal. Typically, a chair control mechanism provides a seat pivot feature for providing pivoting movement of the seat relative to the seat support, as well as a lockout feature for selectively maintaining the seat in a predetermined angular position relative to the seat support. Some types of chair control mechanisms also provide a back mounting feature for supporting the chair back. Some designs simply support the chair back at a predetermined position relative to the seat, while others provide controlled movement of the back in response to changes in the seat angle, such that the seat and back move in a synchronous fashion upon movement of the seat.

It is an object of the present invention to provide a chair control mechanism which functions to support both the seat and the back of a chair. It is another object of the invention to provide such a chair control mechanism which includes a feature for adjusting the range of pivoting movement of the seat relative to the seat support. Yet another object of the invention is to provide such a chair control mechanism in which the angle of the seat can be selectively fixed in a predetermined position relative to the seat support. A still further object of the invention is to provide such a chair control mechanism which provides independent movement of the chair back relative to the seat. A still further object of the invention is to provide such a chair control mechanism which includes a lockout feature for the chair back, to enable the chair back to be fixed in a predetermined angular position relative to the seat regardless of the position of the seat relative to the seat support.

In accordance with the invention, a chair control mechanism adapted to be positioned between a seat support and a seat, includes a base member secured to the seat support and a seat mounting member pivotably engaged with the base member for movement about a seat pivot axis. The seat is adapted to be mounted to the seat mounting member, and an adjustable spring is interposed between the base member and the seat mounting member for biasing the seat toward a predetermined position relative to the seat support. A variable position seat locking arrangement is interposed between the base member and the seat mounting member for selectively retaining the seat in one of a series of predetermined positions against the force of the spring. The variable position seat locking arrangement may include one or more locking pins interconnected with a manually operated actuator mechanism, and each locking pin is selectively engageable within one of a series of seat locking openings formed in a retainer member associated with the seat mounting member. The manually operable actuator mechanism includes a handle and an actuator member which is operable to selectively move one of the seat locking pins into engagement within one of the seat locking openings.

The seat mounting member includes a back mounting arrangement for pivotably mounting the back to the seat mounting member, for movement about a back pivot axis.

The back mounting arrangement includes a back pivot member fixed to the seat mounting member at a location rearwardly of the seat pivot axis. A back mounting bracket is pivotably engaged with the back mounting member, so as to be pivotable relative to the seat mounting member about the back pivot axis which is defined by the back mounting member. With this arrangement, the seat is pivotable about the seat pivot axis relative to the seat support member, and the back is independently pivotable about the back mounting member relative to the seat. A biasing arrangement, such as a torsion spring, is interposed between the seat mounting member and the back mounting bracket for biasing the back forwardly relative to the seat. A variable position back locking arrangement is interposed between the seat mounting member and the back mounting bracket. The variable position back locking arrangement is preferably located forwardly of the back mounting member, and includes one or more back locking pins, each of which is selectively engageable within one of a series of spaced openings associated with the back mounting bracket, for selectively locking the back at a predetermined angle relative to the seat against the force of the spring.

The invention also includes a system for adjusting the range of pivoting movement of the seat relative to the seat support. This aspect of the invention involves the use of a front pivot stop arrangement and a rear pivot stop arrangement, preferably in combination so as to control the range of pivoting movement of the seat relative to the seat support.

The front pivot stop arrangement may be in the form of stop structure associated with either the base or the seat support member of the chair control mechanism, and an engagement member associated with the other of the base member and the seat support member. The stop structure may be in the form of a stop member mounted to the seat support member. The stop member defines an upwardly facing stop surface and one or more slots extending from the stop surface. The engagement member is preferably mounted to the seat support member, and is shiftable between first and second positions. In its first position, the engagement member engages the upwardly facing stop surface of the stop member so as to limit the forward pivoting movement of the seat support member relative to the base member to a first angular position. When shifted to its second position, the engagement member is aligned with one of the slots in the stop member and is receivable within the slot so as to enable the seat mounting member to be pivoted to a second angular position relative to the base section. The engagement member is preferably mounted to a manually operable handle, which can be manipulated by a user to place the engagement member in either its first position or its second position. The stop member and the engagement member are preferably located forwardly of the seat pivot member so as to control the forward pivoting movement of the seat relative to the seat support.

Opposite the stop member and the engagement member, one or more pivot stop members are interposed between the seat support member and the base member for limiting pivoting movement of the seat in the opposite direction of pivoting movement. The one or more pivot stop members are preferably stationarily mounted to the base member rearwardly of the seat pivot member, and each pivot stop member defines a stop surface engageable by the seat support member when the seat support member is pivoted relative to the base member, for limiting pivoting movement of the seat relative to the seat support. In this manner, the height of the stop surface of the pivot stop member determines the angle at which the seat support member engages the stop surface. The pivot stop member is selected from different pivot stop members of varying height, such that the height of the stop surface of the pivot stop member is selected according to the desired pivot angle of the seat support member relative to the base member, to limit the angle of the seat relative to the seat support. In a preferred form, the one or more stop members are selected and placed at the time of manufacture of the chair control mechanism, and are enclosed by the structural components of the chair control mechanism during use. The pivot stop members are preferably employed to limit the range of rearward pivoting movement of the seat support member relative to the base member, and thereby the rearward pivoting angle of the seat relative to the seat support.

The various aspects of the invention can be utilized individually to provide selective enhancements in the features and functioning of a chair control mechanism, or can be used in combination to provide a chair control mechanism with significant enhancements in flexibility in manufacture and operation.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIGS. 3 and 4 are partial section views, both with reference to line 4—4 of FIG. 2, showing the adjustable front pivot limit control feature of the present invention;

FIGS. 5 and 6 are views similar to FIGS. 3 and 4, showing the variable rear pivot stop arrangement incorporated in the chair control mechanism of the present invention;

FIG. 7 is a partial section view taken along line 7—7 of FIG. 3, showing the variable position retainer arrangement for selectively locking the seat in a desired position relative to the seat support;

FIG. 8 is a partial section view taken along line 8—8 of FIG. 3, showing the front pivot limit control feature incorporated in the chair control mechanism of the present invention and illustrating the engagement member shifted to a horizontal lockout position;

FIG. 9 is a partial section view taken along line 9—9 of FIG. 4, showing the engagement member shifted to a position enabling the seat support to be pivoted forwardly beyond horizontal;

FIG. 10 is a partial section view taken along line 10—10 of FIG. 5;

DETAILED DESCRIPTION OF THE INVENTION

Figure 1:
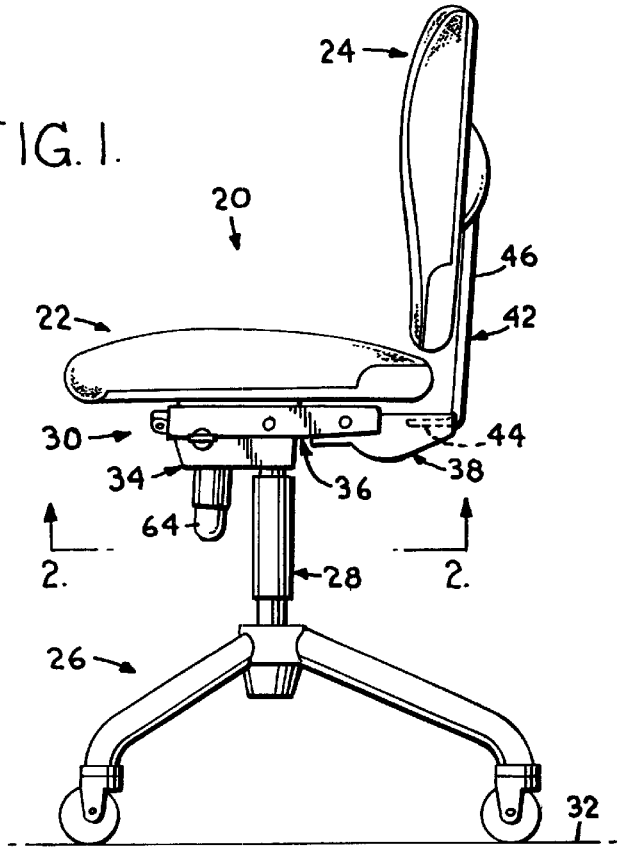
FIG. 1 is a side elevation view of a chair incorporating the improved chair control mechanism of the present invention.

Referring to FIG. 1, a chair 20 generally includes a seat 22, a back 24, a base 26 including a seat support member in the form of an adjustable height cylinder 28, and a chair control mechanism 30. In a manner as is known, seat support cylinder 28 can be adjusted in height so as to vary the elevation of seat 22 relative to a supporting surface, such as a floor 32.

Figure 2:
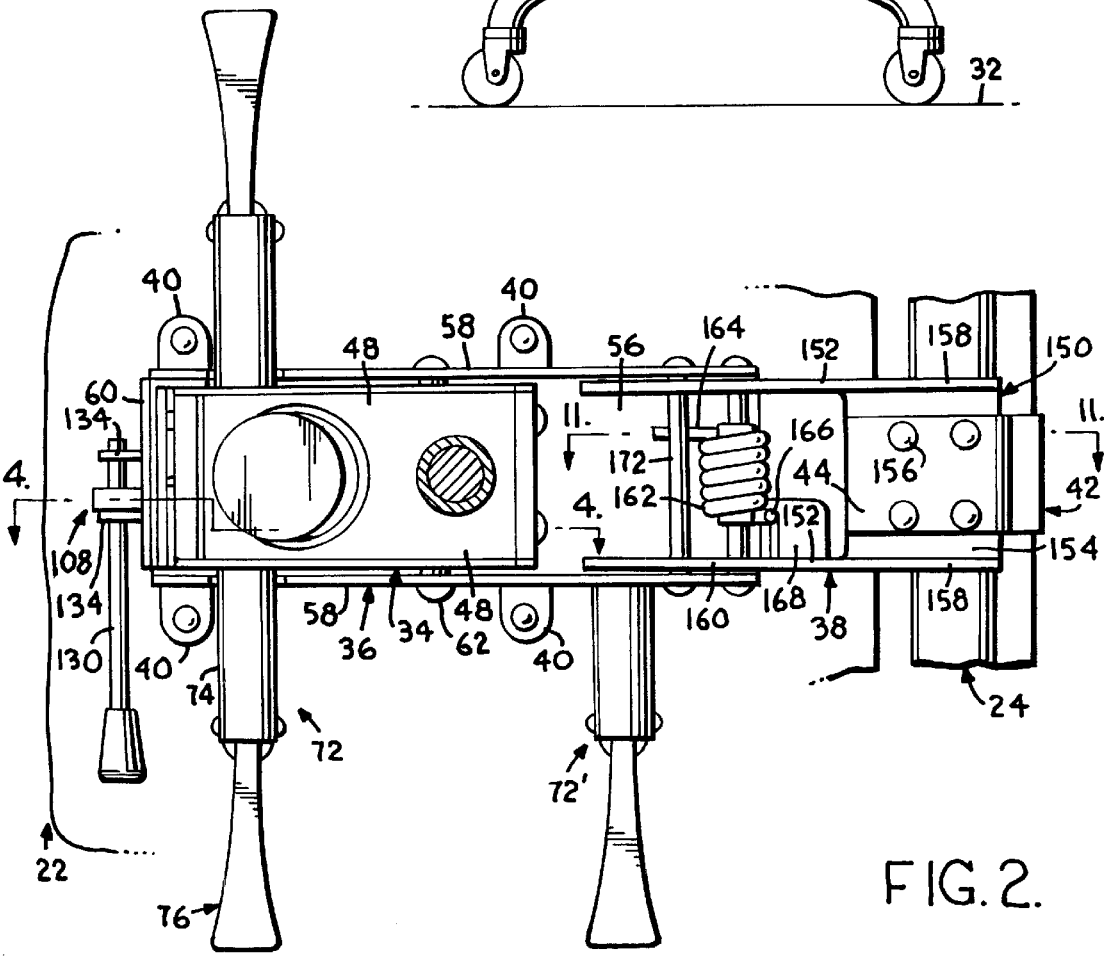
FIG. 2 is a bottom plan view of the chair control mechanism of the present invention, with reference to line 2—2 of FIG. 1.

As shown in FIGS. 1 and 2, chair control mechanism 30 generally includes a base member or section 34, a seat mounting member or section 36, and a back mounting member or section 38. In a known manner, base section 34 is fixed to the upper end of seat support cylinder 28, and seat 22 is mounted to a series of seat mounting tabs 40 forming a part of seat mounting section 36. Back 24 is mounted to a back support bar 42, which is generally L-shaped and includes a lower transverse mounting section 44 and an upstanding back mounting section 46.

Referring to FIGS. 1—3, base section 34 includes a bottom wall 48 and a pair of upstanding sidewalls 50. An angled front wall 52 extends upwardly and forwardly from the forward end of bottom wall 48, and is located between and interconnects the forward ends of sidewalls 50. A transverse reinforcing wall 54 (FIG. 3) extends between sidewalls 50 and is oriented parallel to bottom wall 48. Base section 34 defines an interior which is open upwardly and rearwardly.

Seat mounting section 36 includes a top wall 56 and a pair of depending sidewalls 58. A front wall 60 extends downwardly from the forward end of top wall 56, and extends between and interconnects the forward ends of sidewalls 58. Seat mounting tabs 40, which extend outwardly beyond sidewalls 58, comprise the outer ends of a pair of transverse seat mounting bars 61 secured in any satisfactory manner, such as by welding, to the upwardly facing surface of top wall 56. Seat mounting section 36 defines an internal cavity which opens downwardly and rearwardly.

Sidewalls 58 of seat mounting section 36 are positioned so as to overlap sidewalls 50 of base section 34. A seat pivot member, in the form of a transverse seat pivot pin 62, extends between and pivotably interconnects the overlapping base section sidewalls 50 and seat mounting section sidewalls 58. In this manner, seat mounting section 36 is pivotable relative to base section 34 about a pivot axis defined by the longitudinal axis of seat pivot pin 62. Seat pivot pin 62 is located vertically above and aligned with the upper end of seat support cylinder 28, such that base section 34 and seat mounting section 36 provide a mid-pivot arrangement for seat 22 relative to seat support cylinder 28.

In a manner as is known, a spring bears between base section 34 and seat support section 36, for biasing seat support section 36 forwardly, i.e. in a counterclockwise direction with reference to FIG. 1. A spring tension adjustment mechanism, including a rotatable tension adjusting knob 64, is interconnected with the spring for adjusting the forward bias exerted on seat support section 36.

A variable position seat locking mechanism is interposed between base section 34 and seat mounting section 36, for selectively locking the position of seat mounting section 36 relative to base section 34 and thereby selectively locking seat 22 in position relative to seat support cylinder 28. The variable position seat locking arrangement includes a retainer member in the form of a plate 66 secured at its upper end to the underside of seat mounting section top wall 56. Retainer plate 66 includes a series of front vertically spaced apertures 68 and a series of rear vertically spaced apertures 70 which are vertically staggered relative to front apertures 68. The seat position locking mechanism further includes a seat lock actuator 72 (FIGS. 2, 7) which includes a cylindrical housing 74 and an actuator handle 76 pivotably mounted to the outer end of cylindrical housing 74 via an actuator pivot pin 78. The inner end of cylindrical housing 74 is secured to the outwardly facing surface of one of base section sidewalls 50 in any satisfactory manner, such as by welding.

The construction and operation of seat lock actuator 72 is fully disclosed and described in issued U.S. Pat. No. 6,213,552 granted Apr. 10, 2001 (Ser. No. 09/197,039, filed Nov. 20, 1998), the disclosure of which is hereby incorporated by reference.

Seat lock actuator 72 includes a plunger or slider 80 located within cylindrical housing 74. Actuator handle 76 includes a spherical inner end 82 through which pin 78 extends, for pivotably mounting actuator handle 76 to cylindrical housing 74. Inner end 82 includes a nose-like actuator surface 84 which is engageable with an angled rear surface 86 provided on slider 80. In this manner, pivoting movement of slider end 82 through operation of handle 76 results in selective forward movement of slider 80 within the internal passage of cylindrical housing 74.

A pair of locking pins 88*a*, 88*b* are located within the internal passage of cylindrical housing 74. Locking pins 88*a*, 88*b* include respective outer portions 90*a*, 90*b* received within respective passages 92*a*, 92*b* formed in slider 80, and locking pins 88*a*, 88*b* also define respective inner portions 94*a*, 94*b*. Inner locking pin portions 94*a*, 94*b* extend through respective springs 96*a*, 96*b*, which define outer ends which are received within grooves 98*a*, 98*b*, respectively, formed in locking pins 88*a*, 88*b*, respectively. The inner ends of springs 96*a*, 96*b* bear against the outer surface of base section sidewall 50, and the inner ends of locking pin inner portions 94*a*, 94*b* extend through openings 100*a*, 100*b*, respectively, formed in sidewall 50. A pair of springs 102*a*, 102*b* are received within passages 92*a*, 92*b*, respectively, and bear between the respective ends of passages 92*a*, 92*b* and the outer ends of locking pins 88*a*, 88*b*, respectively. Springs 102*a*, 102*b* urge slider 80 outwardly and urge respective locking pins 88*a*, 88*b* inwardly. With this construction, when actuator handle 96 is moved to a disengaged position, springs 96*a*, 96*b* push respective locking pins 88*a*, 88*b* outwardly away from retainer plate 66, to disengage locking pins 88*a*, 88*b* from retainer plate 66. When actuator handle 76 is moved to its engaged position, as shown in FIG. 7, slider 80 is moved inwardly within the passage of cylindrical housing 74 so as to compress springs 102*a*, 102*b* and to move locking pins 88*a*, 88*b*, respectively toward locking plate 66 against the force of respective springs 96*a*, 96*b*. If one of openings 68, 70 is in alignment with one of locking pins 88*a*, 88*b*, respectively, the locking pin is moved into the opening under the influence of the spring, such as spring 102*a* as is shown in FIG. 7, which biases locking pin 88*a* into one of openings 68. If one of openings 68, 70 is not in alignment with one of locking pins 88*a*, 88*b*, respectively, seat 22 is pivoted so as to bring one of openings 68, 70 into alignment with one of locking pins 88*a*, 88*b*, which results in one of locking pins 88*a*, 88*b* moving into the aligned one of openings 68, 70, so as to fix the angle of seat mounting member 36 relative to base section 34, and thereby seat 22 relative to seat support 28.

With the above construction, seat 22 can be freely pivoted relative to base 28 when actuator handle 76 is in its disengaged position and locking pins 88*a*, 88*b* are disengaged from retainer plate 66. When desired, the angular position of seat 22 can be fixed by moving actuator handle 76 to its engaged position and positioning seat 22 such that one of locking pins 88*a*, 88*b* passes through one of openings 68, 70.

The forwardmost pivoting angle of seat 22 relative to seat support 28 is controlled by an adjustable forward pivot limiting mechanism 104, which generally includes a stop member 106 and a shiftable engagement member 108. Stop member 106 is mounted to the upper end of base section front wall 52 in any satisfactory manner. As illustrated in FIGS. 4, 8 and 9, stop member 106 includes a mounting section 110 defining a downwardly facing channel within which the upper end of base section front wall 52 is received. A pair of integral molded pins 112 secure mounting section 110 to front wall 52 in a snap-fit manner, so as to maintain stop member 106 in position.

Stop member 106 includes a central stop 116 and a pair of end members 118. A pair of slots 120 are defined between central stop 116 and end members 118.

Shiftable engagement member 108 is mounted exteriorly on seat mounting section 36, and includes a main body section 122, and an inwardly extending upper arm 124 which extends through a slot 126 formed in seat mounting section front wall 60. Upper arm 124 terminates in an engagement section 128 located within the interior of seat mounting section 36.

An actuator rod 130 extends through a transverse passage 132 formed in engagement member body section 122. Actuator rod 130 is slidably received within a pair of aligned openings formed in a pair of ears 134, which are formed integrally with the material of front wall 60 and are bent forwardly so as to extend from the forward facing surface of front wall 60. Engagement member 108 is located between ears 134. With this arrangement, the user can manually engage the outer end of actuator rod 130 and exert an axial force on actuator rod 130, which results in shifting movement of engagement member 108 along the longitudinal axis of actuator rod 130, between first and second positions illustrated in FIGS. 3 and 4, respectively.

When engagement member 108 is in its first position as shown in FIGS. 3 and 8, engagement section 128 is in alignment with central stop 116 of stop member 106. When engagement member 108 is in this position, engagement section 128 engages the upper end of central stop 116, as shown in FIGS. 3 and 8, to limit the forward range of pivoting movement of seat mounting section 36 relative to base section 34, and thereby seat 22 relative to seat support cylinder 28. Representatively, central stop 116 and engagement section 128 may be located and configured so as to provide a zero degree forward stop for seat 22.

When it is desired to increase the range of pivoting movement of seat 22 relative to seat support 28, engagement member 108 is shifted to its second position as shown in FIGS. 4 and 9. With engagement member 108 in this position, engagement section 128 is aligned with one of slots 120 on either side of central stop 116. Accordingly, engagement section 128 is received within slot 120 when seat mounting section 36 is pivoted forwardly relative to base section 34, to provide an increased range of forward pivoting movement of seat 22 relative to seat support cylinder 28. Slot 120 has a depth greater than the height of engagement section 128, such that central stop 116 and end members 118 engage: the underside of seat mounting section top wall 56 to limit the forward pivoting movement of seat mounting section 36 relative to base section 34, and thereby seat 22 relative to seat support cylinder 28. Respectively, central stop 116 and end members 118 may be located and configured to provide a two degree forward stop for seat 22. In this manner, the shifting of engagement member 122 functions to limit forward pivoting movement of seat 22 to one of two predetermined, discrete forward tilt limit positions.

Rearwardly of seat pivot member 62, a rear pivot stop member 136 (FIG. 3) is engaged with base section 34 for limiting the rearward pivoting movement of seat mounting section 36 relative to base section 34, and thereby seat 22 relative to seat support cylinder 28. Pivot stop member 136 includes an arcuate upwardly facing stop surface 138, which extends upwardly from a disc section 140. A mounting stub 142 extends downwardly from disc section 140, through an aperture 144 formed in a mounting bar 146 which extends between base section sidewalls 50. Preferably, a pair of pivot stop members 136 are mounted to mounting bar 146 at spaced locations between sidewalls 50.

Figure 6:
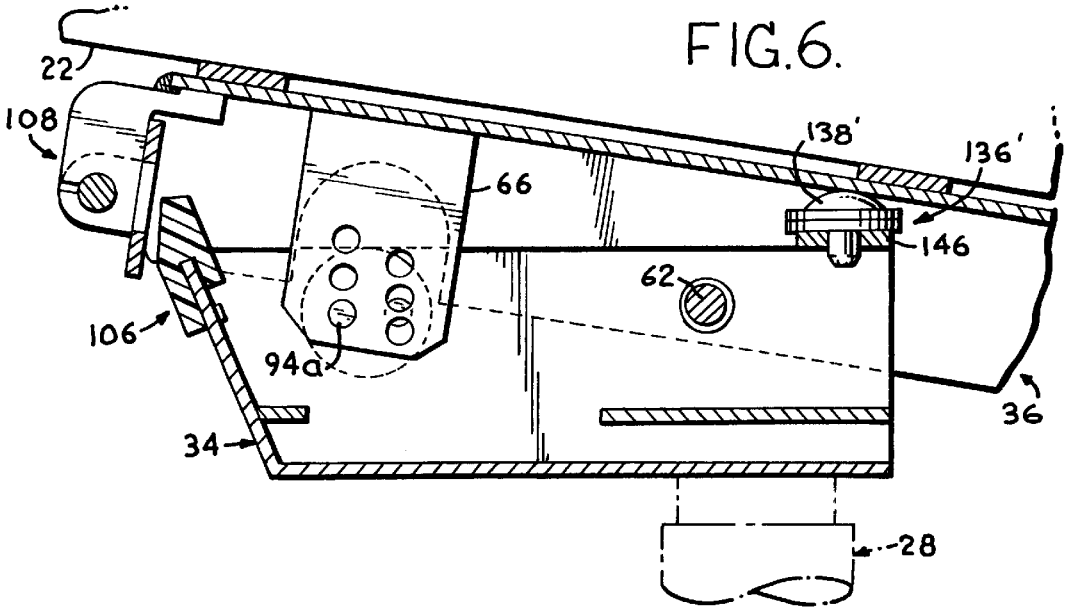

As shown in FIG. 6, the underside of seat mounting section top wall 56 engages stop surface 138 of pivot stop members 136 when seat mounting section 36 attains a predetermined rearward pivot angle relative to base section 34 upon pivoting movement about seat pivot member 62. In this manner, pivot stop members 136 function to limit the pivoting rear movement of seat mounting section 36 relative to base section 34, and thereby seat 22 relative to seat support cylinder 28.

The limit of rearward pivoting movement of seat mounting section 36 can be adjusted by varying the elevation of stop surface 138. Representatively, as shown in FIG. 6, a pivot stop member 136' may be engaged with mounting bar 146 in the same manner as pivot stop member 136. However, pivot stop member 136' has a height greater than that of pivot stop member 136. As shown, disc section 140' of pivot stop member 136' has a greater height than disc section 140 of pivot stop member 136, such that stop surface 138' of pivot stop member 136' is at an elevation above that of stop surface 138 of pivot stop member 136. Accordingly, stop surface 138' of pivot stop member 136' engages the underside of seat mounting section top wall 56 at a lesser angle of pivoting movement about seat pivot member 62 than pivot stop member 136, such that the limit of rearward movement of seat 22 is less with pivot stop member 136' than with pivot stop member 136. In this manner, the rear pivot limit of seat 22 can be controlled by selecting a desired height for the rear pivot stop member, from a variety of pivot stop members of varying height. Alternatively, the height of the same rear pivot stop member can be altered, such as by adding washers or other types of spacers between mounting bar 146 and stop surface 138 of pivot stop member 136.

While pivot stop members 136, 136' are illustrated as being located rearwardly of seat pivot member 62 and pivot limiting mechanism 104 has been illustrated as being located forwardly of seat pivot member 62, it should be understood that an adjustable pivot limit mechanism such as 104 may also be located rearwardly of seat pivot member 62 for varying the range of rear pivoting movement of seat 22 relative to seat support cylinder 28. Likewise, it should be understood that a variable position pivot stop such as 136, 136' may also be located forwardly of seat pivot member 62 for controlling the forward range of pivoting movement of seat 22 relative to seat support member 28.

Figure 11:
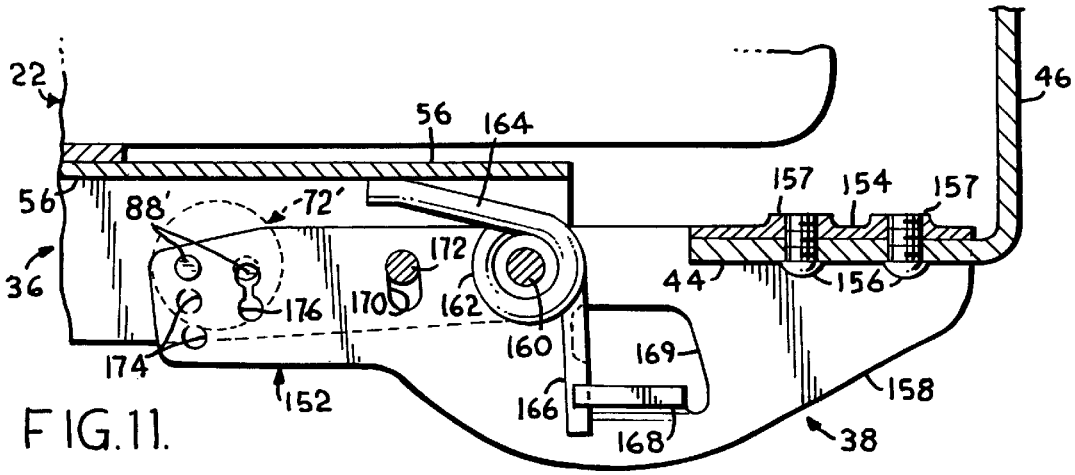
FIG. 11 is a partial section view taken along line 11—11 of FIG. 2, showing the pivotable back mounting feature incorporated in the chair control mechanism of the present invention.
Figure 12:
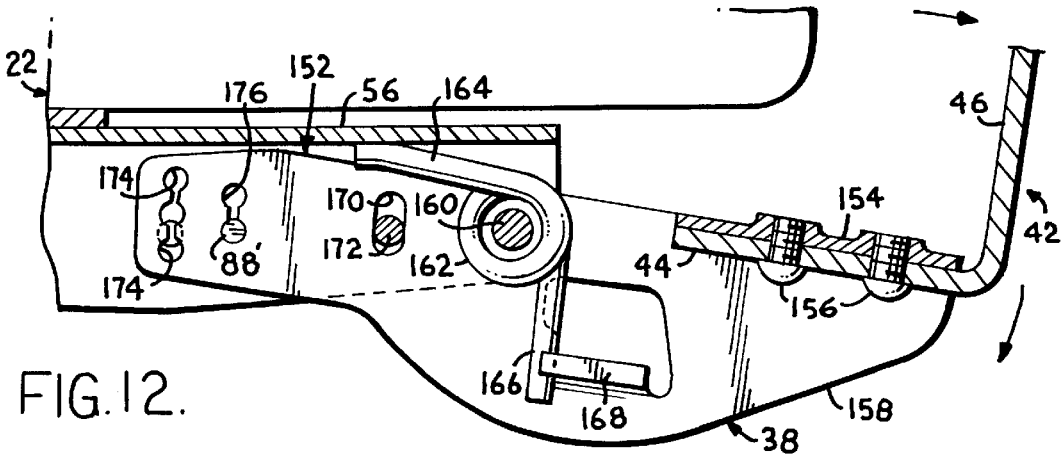
FIG. 12 is a view similar to FIG. 11, showing pivoting movement of the back mounting bracket relative to the seat support member and retained in position using the variable position back locking feature incorporated in the chair control mechanism of the present invention.

Referring to FIGS. 2, 11 and 12, back mounting section 38 includes a rear back mounting bracket 150 and a pair of spaced apart forwardly-extending arms 152 extending forwardly from back mounting bracket 150. Back mounting bracket 150 defines a transverse mounting plate 154 to which lower mounting section 44 of back support bar 42 is secured via a series of screws 156 which extend into threaded openings in a series of mounting bosses 157 formed in mounting plate 154, together with a pair of side flanges 158 which depend from plate 154. Arms 152 are continuous with flanges 158.

A back pivot member 160, in the form of a headed pin, extends between seat mounting member sidewalls 58 and through aligned apertures formed in arms 152, to pivotably mount back mounting section 38 to the rearward end of seat mounting section 36. In this manner, back mounting section 38 is pivotable about a transverse pivot axis defined by the longitudinal axis of back pivot member 160, relative to seat mounting section 36 at a location spaced rearwardly from seat support cylinder 28 and seat pivot member 62.

Back pivot member 160 extends through the coil of a torsion spring 162, which defines an upper leg 164 which engages the underside of seat mounting section top wall 56, and a downwardly extending leg 166 which engages a retainer tab 168 which is formed from an inwardly bent section of one of flanges 158 defined by a cut-out 169. Torsion spring 162 functions to bias back mounting section 38 in a counterclockwise direction, with reference to FIG. 1, to urge back 24 forwardly relative to seat 22.

Arms 152 of back mounting section 38 define a pair of aligned arcuate slots 170. A stop member 172, in the form of a dual headed pin, extends between seat mounting section sidewalls 58 and through aligned slots 170. Engagement of stop member 172 with the ends of slots 170 functions to control the range of pivoting movement of back mounting section 38 relative to seat mounting section 36, and thereby of back 24 relative to seat 22. As shown in FIG. 11, torsion spring 162 functions to bias back mounting member 38 to a position in which stop member 178 is engaged with the upper ends of slots 170, which :corresponds to the forward-most position of back 24 relative to seat 22.

Both of arms 152 are provided with a forward series of vertically spaced apertures 174 and a pair of rearwardly offset vertically spaced apertures 176. Apertures 174, 176 are aligned with a pair of apertures in one of seat mounting section sidewalls 58. A back lock actuator, shown in FIG. 2 at 72', is secured to seat mounting section sidewall 58. Back lock actuator 72' is constructed identically to seat lock actuator 72, including a pair of locking pins 88' which extend through the apertures in seat mounting section sidewall 58. In the same manner as described previously with respect to seat lock actuator 72, each locking pin 88' is adapted to be received within one of apertures 174, 176 for selectively fixing back mounting section 38 in one of a series of predetermined angular positions relative to seat mounting section 36, and thereby selectively locking the angle of back 24 relative to seat 22. With this construction, back 24 is movable relative to seat 22 independently of the angle of seat 22 relative to seat support cylinder 28. Accordingly, the user is able to move back 24 to any desired position relative to seat 22. Back 24 can either be locked in a predetermined position by engagement of one of locking pins 88' within one of apertures 174, 176 when back lock actuator 72' is engaged, or can be freely pivotable relative to seat 22 when back lock actuator 72' is disengaged.

It can thus be appreciated that chair control mechanism 30 incorporates several features which enhance the adjustability in seat and back tilt as welt as providing selective locking of the seat and back, both separately and with respect to each other.

While the invention has been illustrated in connection with a pin and opening type of position locking arrangement, it is understood that other types of pivot locking arrangements may be employed, such as a friction disc arrangement or the like. In addition, it is understood that slots 170 and stop member 172 may be eliminated and replaced with direct engagement of portions of back mounting section 38 with seat mounting section 36 so as to control the range of pivoting movement of back mounting section 38. Other variations in construction and assembly details are contemplated and known to those of ordinary skill in the art.

Various alternatives and embodiments are contemplated as being within the scope of the following claims particularly pointing out and distinctly claiming the subject matter regarded as the invention.

We claim:

1. A chair control mechanism for a chair having a seat, a back and a seat support, comprising:

a base member adapted to be secured to the seat support;

a seat mounting member pivotably interconnected with the base member, wherein the seat is adapted to be mounted to the seat mounting member and wherein pivoting movement of the seat mounting member relative to the base member functions to pivot the seat relative to the seat support;

a back mounting member pivotably interconnected with the seat mounting member at a location spaced from the pivotable interconnection of the seat mounting member with the base member, wherein the back is adapted to be mounted to the back mounting member and wherein pivoting movement of the back mounting member relative to the seat mounting member functions to pivot the back relative to the seat;

an adjustable back position lock arrangement interposed between the seat mounting member and the back mounting member for selectively locking the position of the back relative to the seat in one of a plurality of selected positions; and a seat position adjustment arrangement interposed between the base section and the seat mounting member for adjustably controlling the range of pivoting movement of the seat relative to the seat support member.

2. The chair control mechanism of claim 1, further comprising a variable position selectively operable seat locking arrangement interposed between the base member and the seat mounting member for selectively fixing the position of the seat mounting member in one of a plurality of predetermined positions relative to the base member, for selectively fixing the position of the seat relative to the seat support.

3. The chair control mechanism of claim 1, wherein the seat mounting member is pivotably interconnected with the base member for movement about a transverse seat pivot axis, wherein the seat position adjustment arrangement is operable to engage the seat support member forwardly and rearwardly of the transverse seat pivot axis to define the forwardmost an rearwardmost pivotable position of the seat relative to the seat support.

4. The chair control mechanism of claim 3, wherein the seat position adjustment arrangement includes a shiftable forward stop arrangement which includes a shiftable engagement member defining an engagement surface area, and stop structure defining a stop surface, wherein the engagement member engages one or the other of the stop surfaces for controlling forward pivoting movement of the seat.

5. The chair control mechanism of claim 3, wherein the seat position adjustment arrangement comprises a stationary rear stop member interposed between the seat mounting member and the base member, wherein the rear stop member is selected from a plurality of rear stop members of different height, wherein the height of the selected rear stop member determines the rearwardmost pivoting position of the seat support member relative to the base member.

6. The chair control mechanism of claim 1, wherein the back mounting member is pivotably interconnected with the seat mounting member for movement about a back pivot axis, wherein the back is engaged with the back mounting member rearwardly of the back pivot axis and wherein the back mounting member includes a forward portion located forwardly of the back pivot axis, wherein the adjustable back position lock arrangement comprises a plurality of openings formed in the forward portion of the back mounting member, and a movable engagement member interconnected with the seat mounting member and selectively engageable within one of the openings for fixing the position of the back mounting member in one of a plurality of positions relative to the seat mounting member.

7. The chair control mechanism of claim 6, further comprising a biasing arrangement interconnected between the back mounting member and the seat mounting member for biasing the back mounting member forwardly relative to the seat mounting member.

8. A method of adjusting the range of pivoting movement of a seat relative to a seat support, wherein a chair control mechanism having a base section and a pivotable seat mounting section is located between the seat and the seat support, wherein the seat mounting section is pivotable about a seat pivot axis relative to the base section, comprising the steps of:

providing first and second pivot stops, wherein the first pivot stop defines a first height and the second pivot stop defines a second height; and securing a selected one of the first and second pivot stops between the base section and the pivotable seat mounting section at a location offset from the seat pivot axis, wherein the first and second heights of the first and second pivot stops, respectively, function to control the range of pivoting movement of the seat mounting section relative to the base section.

9. The method of claim 8, wherein the step of securing a selected one of the first and second pivot stops is carried out by mounting the selected pivot stop to a mounting arrangement located rearwardly of the seat pivot axis such that the pivot stop controls the range of rearward pivoting movement of the seat support section relative to the base section.

10. The method of claim 9, wherein each pivot stop includes mounting structure engageable with the mounting arrangement and a stop surface spaced above the mounting structure and engageable with a surface defined by the seat mounting section.

11. The method of claims 10, wherein the mounting structure comprises a mounting member provided on the base section, and wherein the stop surface is engageable with a downwardly facing surface defined by the seat mounting section for engaging the seat mounting section and controlling pivoting movement of the seat mounting section relative to the base section.

12. The method of claim 8, further comprising the step of providing a variable position seat pivot arrangement between the base section and the seat mounting section at a location offset from the seat pivot axis in a direction opposite the selected one of the first and second pivot stops secured to the base section.

13. The method of claim 12, wherein the step of providing a variable position seat pivot arrangement is carried out by mounting a shiftable engagement member to the seat mounting section, mounting a dual position stop member to the base section, and selectively positioning the engagement member so as to interact with the stop member in either a first position or a second position to control the range of pivoting movement of the seat mounting section in a second direction of pivoting movement relative to the base section.

14. A seat pivot limiting arrangement for controlling the range of pivoting movement of a seat relative to a seat support, wherein a chair control mechanism having a base section and a pivotable seat mounting section is located between the seat and the seat support, wherein the seat mounting section is pivotable about a seat pivot axis relative to the base section, comprising:

a pivot stop secured to the base section at a location offset from the seat pivot axis, wherein the pivot stop includes a stop surface and mounting structure enable with the seat mounting section for securing the pivot stop the seat mounting section, wherein engagement of the stop surface with the seat mounting section functions to control the range of pivoting movement of the seat support member relative to the base member, and wherein the stop surface defines a predetermined height, wherein the pivot stop member is selected from two or more pivot stop members, each of which has stop surfaces of differing heights, wherein the selected pivot stop member defines a range of pivoting movement of the seat mounting section relative to the base section different than that of the remaining pivot stop members.

* * * * *